US005980025A

United States Patent [19]

Burke et al.

[11] Patent Number: 5,980,025

[45] Date of Patent: Nov. 9, 1999

[54] THERMAL INKJET PRINTHEAD WITH INCREASED RESISTANCE CONTROL AND METHOD FOR MAKING THE PRINTHEAD

[75] Inventors: Cathie J. Burke, Rochester; Alan D. Raisanen, Sodus, both of N.Y.

[73] Assignee: Xerox Corporation, Stamford, Conn.

[21] Appl. No.: 08/976,419

[22] Filed: Nov. 21, 1997

[51] Int. Cl.[6] ..... B41J 2/05

[52] U.S. Cl. ..... 347/62; 29/890.1

[58] Field of Search ..... 347/62, 63, 64; 29/890.1

[56] References Cited

U.S. PATENT DOCUMENTS

| | | | |
|---|---|---|---|
| Re. 32,572 | 1/1988 | Hawkins et al. | 156/626 |
| 4,532,530 | 7/1985 | Hawkins | 347/62 |
| 4,774,530 | 9/1988 | Hawkins | 346/140 R |
| 4,935,752 | 6/1990 | Hawkins | 347/62 |
| 4,951,063 | 8/1990 | Hawkins et al. | 346/1.1 |
| 5,636,441 | 6/1997 | Meyer et al. | 29/890.1 |
| 5,742,307 | 4/1998 | Watrobski et al. | 347/62 |

*Primary Examiner*—Fred L Braun

[57] ABSTRACT

A thermal ink jet printhead is improved by providing a heater resistor which is mechanically isolated from overlying nitride and tantalum layers by growing a thin buffer oxide layer on the surface of the resistor heater layer. The introduction of the buffer oxide layer permits a thinner nitride layer which, in turn, reduces electrical resistance changes which would otherwise be introduced into the resistor arrays by mechanical stress after the nitride layer is deposited.

6 Claims, 2 Drawing Sheets

THERMAL INKJET PRINTHEAD WITH INCREASED RESISTANCE CONTROL AND METHOD FOR MAKING THE PRINTHEAD

BACKGROUND OF THE INVENTION AND MATERIAL DISCLOSURE STATEMENT

The invention relates generally to thermal ink jet printing and, more particularly, to printheads with polysilicon resistive heaters provided with improved resistance control.

Thermal ink jet printing is generally a drop-on-demand type of ink jet printing which uses thermal energy to produce a vapor bubble in an ink-filled channel that expels a droplet. A thermal energy generator or heating element, usually a resistor, is located in the channels near the nozzle a predetermined distance therefrom. An ink nucleation process is initiated by individually addressing resistors with short (2–6$\mu$ second) electrical pulses to momentarily vaporize the ink and form a bubble which expels an ink droplet. As the bubble grows, the ink bulges from the nozzle and is contained by the surface tension of the ink as a meniscus. As the bubble begins to collapse, the ink still in the channel between the nozzle and bubble starts to move towards the collapsing bubble, causing a volumetric contraction of the ink at the nozzle and resulting in the separating of the bulging ink as a droplet. The acceleration of the ink out of the nozzle while the bubble is growing provides the momentum and velocity of the droplet in a substantially straight line direction towards a recording medium, such as paper.

In a prior art printhead 8 of the type disclosed in U.S. Pat. No. 4,951,063, whose contents are hereby incorporated by reference, and shown in partial cross-section in FIG. 1, a silicon heater substrate 28 has formed on its surface a field oxide layer 39. Polysilicon heater elements 34 are formed followed by a reflowed PSG, thermal oxide composite layer 13, which serves to protect and insulate the heating elements. Layer 13 is masked and etched to produce vias for subsequent interconnection with addressing electrodes 33 and common return electrodes 35. In addition, layer 13 is concurrently removed from the central bubble generating region of the heater element 34. A pyrolytic silicon nitride layer 17 is deposited directly over the heater elements. Layer 17 has a thickness of between 500 Å to 2500 Å and, optimally, about 1500 Å. A tantalum layer 12 of 0.1 to 1.0$\mu$ thickness is deposited on layer 17. Layer 12 protects the heater element 34 from the corrosive effects of the ink and layer 17 provides electrical isolation. For electrode passivation, a silicon dioxide and/or silicon nitride film 16 is deposited over the entire heater surface followed by a thick insulative polymer layer 18.

Ink in fill channels 20 flows into recess 26 overlying the passivated resistor elements. When the resistor element is pulsed, ink is heated and expelled through nozzle 27 in the printhead front face.

A problem with the prior art fabrication of the type of printhead shown in FIG. 1 is that the nitride layer 17 is typically deposited by a low-pressure chemical vapor deposition (LPCVD) process, a process which produces a nitride layer with a high compressive stress of up to 6×108 dynes/cm$^2$. This highly stressed layer applies a mechanical strain to the underlying polysilicon layer 34, resulting in changes in resistivity of the layer due to piezoresistive effects and to redistribution of dopants between the polysilicon grain boundaries and in the crystallite bulk. Since the amount of stress varies between fabrication runs as a function of the total amount of deposition which has been performed in the reactor and with the age and condition of the vacuum system, the increase in the polysilicon resistance also varies making it difficult to fabricate printheads with consistent resistor heater characteristics. The magnitude of this problem increases with increasing heater polysilicon resistance.

Other potential problems with the prior art process are experienced at the "step" areas when the nitride and tantalum layers conform to the slope of the glass oxide composite layer 13. As shown enlarged in FIG. 1, the deposited layers have higher stress at the step edges 40 sometimes causing cracking. The deposited layers also tend to thin out along area 42, which can further encourage cracking. A third potential problem is that the nitride layer 17 could be undercut at areas 44 during the etch process reducing the quality of the seal to layer 13. All three of these mechanisms offer potential leakage paths for the ink to infiltrate the seal over the heater, which results in ink electrochemically attacking the polysilicon resistor element itself and destroying the heater structure, or causing an electrical short circuit and destroying the driver or addressing circuitry.

SUMMARY OF THE INVENTION

It is desirable to fabricate a thermal ink jet printhead with heater elements having predictable resistance values following ink passivation steps.

It is also desirable to reduce cracking of the heater passivation layers at edge areas and to utilize a nitride layer overlying the resistor elements with improved sealing of the resistor elements.

According to the invention, a thin buffer oxide film is deposited over the polysilicon heater elements followed by deposition of a thinner-than-normal silicon nitride layer. A glass oxide composite layer is subsequently deposited. By depositing the nitride layer before the glass layer, the topography which must be covered by the nitride layer is substantially reduced. Further, the nitride layer can be significantly reduced in thickness without the cracking and thinning observed in the enlarged area of FIG. 1, since the degree of cracking and thinning is directly proportional to the height of the topography which must be covered. In addition, since the nitride is deposited as a continuous blanket layer beneath the glass layer, the quality of the seal between the nitride layer and glass becomes much less critical, since any ink which infiltrates past the glass-to-nitride seal will be stopped at the continuous nitride film underlying the glass.

More particularly, the present invention relates to a thermal ink jet printhead including a plurality of ink-filled channels in thermal connection with a resistor heater section, the resistor heater section including:

a silicon substrate with an overlying dielectric layer, an array of heater resistors formed thereon, the array comprising a first moderately-doped $n^+$polysilicon layer and a buffer oxide layer overlying said polysilicon layer, a silicon nitride layer overlying said buffer oxide layer, a tantalum layer overlying said nitride layer, passivation means for providing thermal isolation and ink erosion protection and electrical circuits connected to said resistor array for providing input drive signals.

Further, the invention relates to a method for fabricating an improved printhead for an ink jet printer, the printhead including a plurality of ink-filled channels in thermal communication with a heater resistor array, comprising the steps of:

(a) forming a silicon substrate, (b) growing or depositing a dielectric layer on the substrate surface, (c) forming a layer of resistive material overlying said dielectric oxide layer to form a resistor heater array, (d) growing a thin insulating buffer oxide layer on the surface of the layer of resistive material, (e) depositing a silicon nitride layer over the buffer oxide layer, (f) forming vias and metal connection to said resistor heater array and (g) forming a passivating layer to provide thermal isolation and ink erosion protection for the resistor heaters and driver/addressing electronics.

DESCRIPTION OF THE INVENTION

Figure 1:
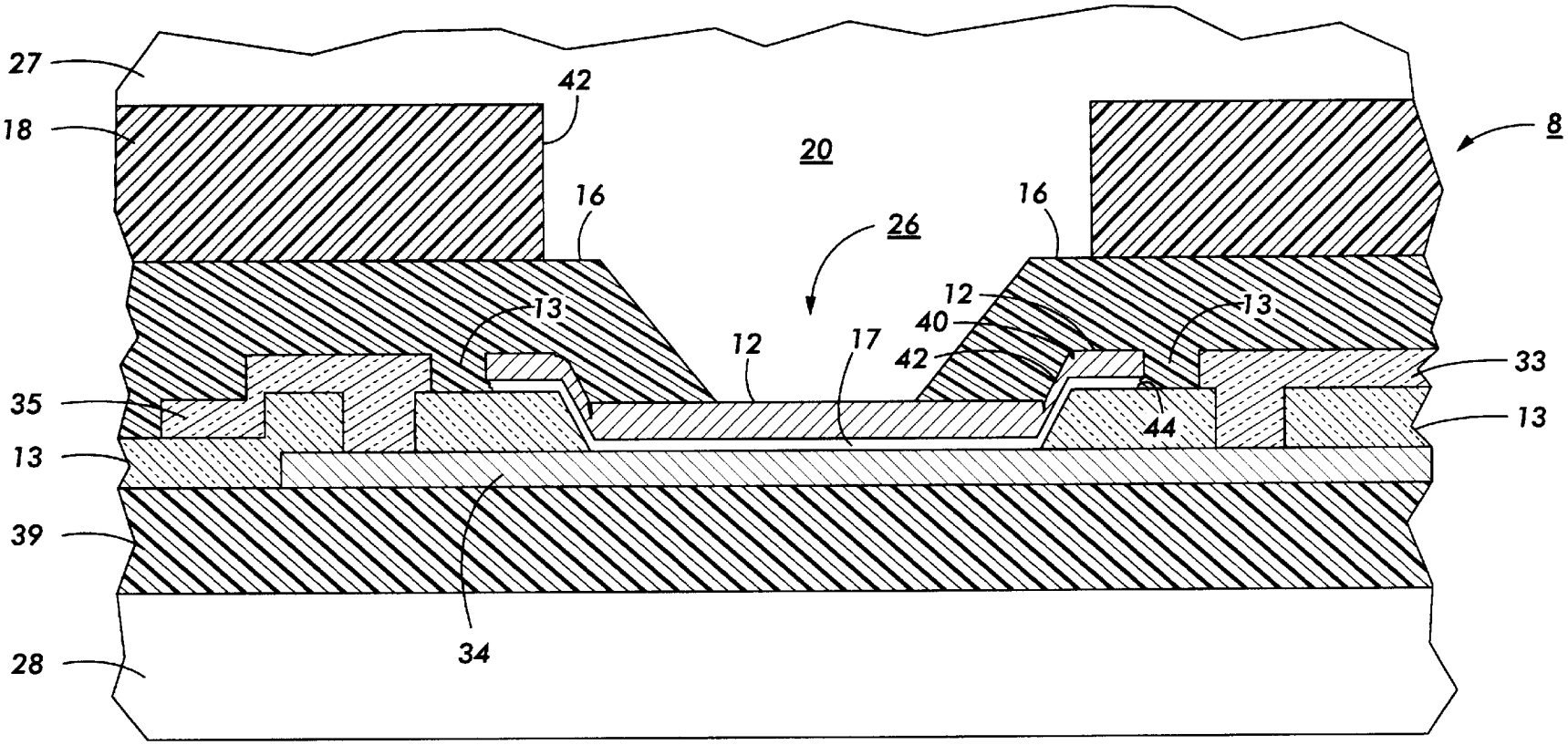
FIG. 1 PRIOR ART
FIG. 1 is an enlarged, cross-sectional view of a prior art ink jet printhead.
Figure 2:
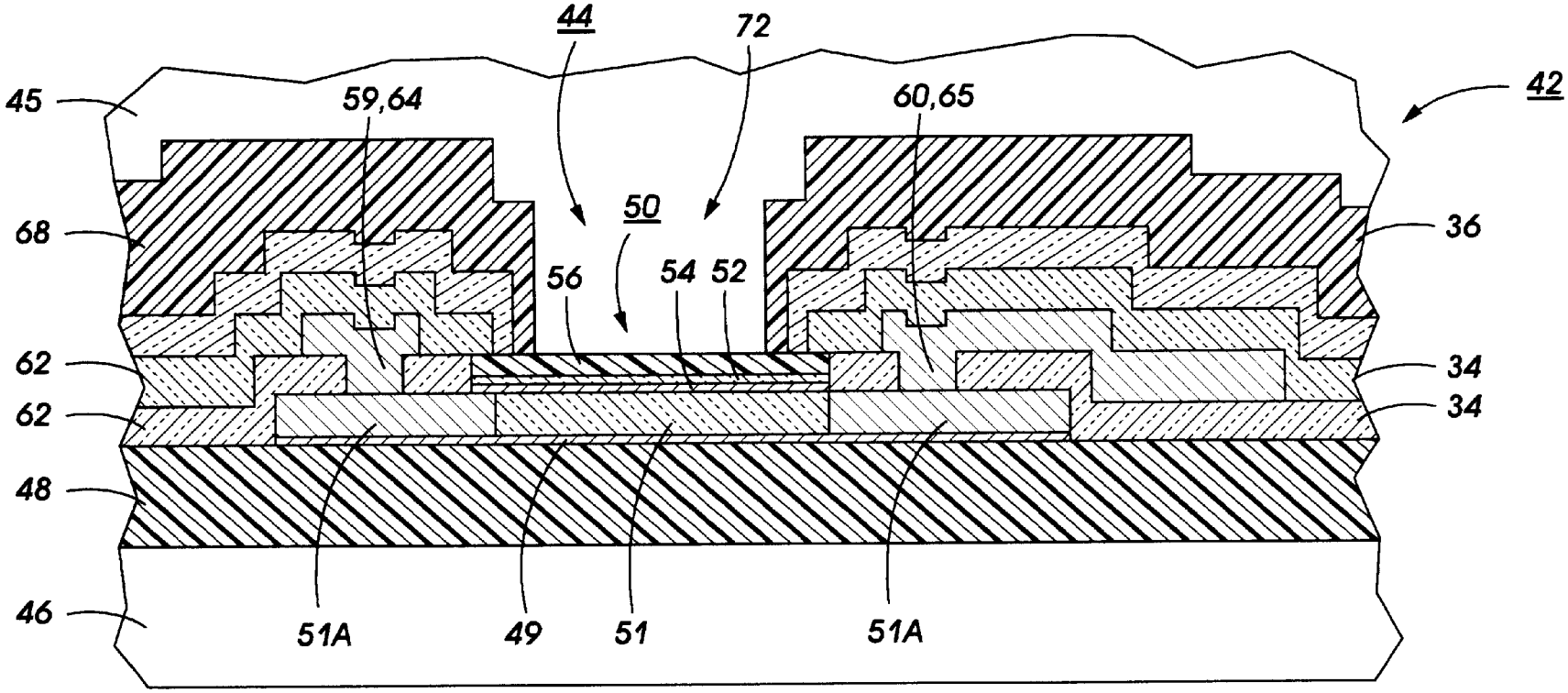
FIG. 2 is an enlarged, cross-sectional view of the ink jet printhead of the present invention.

FIG. 2 is a cross-sectional view of an embodiment of an improved resistive heater structure which can be used, for example, in a printhead of the type disclosed in U.S. Pat. Re. Nos. 32,572, 4,774,530 and 4,951,063, whose contents are hereby incorporated by reference. It is understood that the improved heater structures of the present invention can be used in other types of thermal ink jet printheads where a resistive element is heated to nucleate ink in an adjoining layer.

Referring to FIG. 2, the heater substrate portion of an ink jet printhead 42 is shown with ink in channel 44 being ejected from nozzle 45. Printhead 42 is fabricated by the process steps disclosed by the patents referenced supra modified according to the invention concepts disclosed below. A silicon substrate 46 has an underglaze layer 48 of a thermal insulator formed on its surface. A gate oxide layer 49 is formed on the surface of layer 48 if the heater structure is integrated on the same wafer with addressing or driver devices. The gate oxide is grown as a component of active transistor devices elsewhere on the wafer, and in the heater area serves only to slightly increase the effective thickness of the underglaze layer 48. Heater elements 50 are formed on layer 49. According to the invention, and in a preferred embodiment, the resistor 50 comprises a section 51 of moderately-doped $n^+$polysilicon with the heater ends 51A of heavily-doped $n^{++}$polysilicon. The heavily-doped heater ends 51A are for the purpose of reducing the contact resistance of the electrical interconnection to the aluminum electrodes. According to the invention, a thin buffer oxide layer 54 is grown or deposited on the surface of layer 51. In a preferred embodiment, the oxide is grown in dry oxygen at 800–1000° C. until an optimum thickness of approximately 50–1000 Å is reached. Formation of a nitride layer 52 immediately follows formation of layer 54. The nitride layer can be reduced proportionately to maintain the thermal conductivity properties of the heater passivation stack; e.g., to a thickness of 500 Å as compared to the prior art thickness of 1500 Å. Contact windows (vias) 59, 60 are formed by first depositing a thermal oxide/doped LPCVD oxide composite layer 62, then etching with a buffered hydrofluoric acid wet etch through layer 62 to open contact windows 59 and 60 as well as the opening over the heater 72. Alternatively, these layers can be dry etched by a plasma process. A protective tantalum layer 56 is deposited on layer 52 and 62, then masked and plasma etched away everywhere but over the heater opening 72. A hot phosphoric acid wet etch or plasma dry etch is then used to remove the nitride layer 54 remaining at the bottoms of the contact vias to expose conductive heater ends 51A. A metallization and etch step follows, forming aluminum address electrodes 64 and aluminum counter return electrodes 65. One or more additional doped LPCVD glass intermetal dielectric layers 62 may follow, depending how many aluminum metal interconnect levels are required for driver and address electronics elsewhere on the device. A hard passivation layer composed of doped LPCVD oxide and/or plasma-enhanced CVD nitride is used to protect the interconnect layers 64, 65 and the intermetal dielectric layers 62 from mechanical damage or chemical attack, followed by a thick film layer 68, polyimide, in a preferred embodiment. Ink fill channels 44 flow into heater pit 72 and come into thermal contact with resistor 50. Electrical input signals are applied across the metalization electrodes 64, 65 to provide drive or pulse signals to the resistors which cause vapor bubble nucleation in the overlying ink and ejection of ink through the nozzles.

The buffer oxide layer 54 can be grown to a thickness of between 50 Å and 1500 Å.

Layer 54 elastically or plastically deforms under the stress inherent in the nitride layer 52, reducing the stress transmitted down to the polysilicon layer. Also, the thinner nitride layer 52 has a lower stress than the thicker layer used in the prior art, simply by being thinner, which also helps to reduce the stress on the polysilicon heater. The changes in resistance of resistor 50 are correspondingly reduced resulting in more consistent and predictable heater characteristics. The thinner nitride layer enabled by the buffer oxide layer also reduces the edge cracking phenomenon of the prior art and alleviates the seal problem associated with nitride layer etching step. As an additional improvement to reliability, any pinholes or microcracks formed in the thin nitride layer will tend to be sealed by the underlying oxide layer 54.

While the embodiment disclosed herein is preferred, it will be appreciated from this teaching that various alternative, modifications, variations or improvements therein may be made by those skilled in the art, which are intended to be encompassed by the following claims:

We claim:

1. A thermal ink jet printhead including a plurality of ink-filled channels in thermal connection with a resistor heater section, the resistor heater section including:

a substrate with an overlying dielectric layer, an array of heater resistors formed thereon, the array comprising a first $n^+$polysilicon layer and a thin buffer oxide layer overlying said polysilicon layer, a silicon nitride layer overlying said buffer oxide layer, a tantalum layer overlying said nitride layer, electrical circuits connected to said resistor array for providing input drive signals, and passivation means for providing electrical isolation and ink erosion protection.

2. The printhead of claim 1 wherein said thin buffer oxide layer is grown in dry oxygen to a thickness of between 50 and 1500 Å.

3. The printhead of claim 1 wherein a silicon nitride layer with a thickness of between 100 and 2500 Å is deposited on said buffer oxide layer.

4. A method for fabricating an improved printhead for an ink jet printer, the printhead including a plurality of ink-filled channels in thermal communication with a heater resistor array, comprising the steps of:

(a) forming a silicon substrate, (b) growing a field oxide layer on the substrate surface, (c) forming a layer of resistive material overlying said field oxide layer to form a resistor heater array, (d) growing a thin insulating buffer oxide layer on the surface of the layer of resistive material, (e) depositing a silicon nitride layer over the buffer oxide layer, (f) forming vias and metal connection to said resistor heater array and (g) forming a passivating layer to provide thermal isolation and ink erosion protection for the resistor heaters.

5. The method of claim 4 wherein the thin buffer oxide film is grown in dry oxygen at approximately 800–1000° C. for a period of time sufficient to grow a layer with a thickness of between 50 and 1000 Å.

6. The method of claim 4 wherein the silicon nitride layer is deposited to a thickness of between 100 and 2500 Å.

* * * * *